United States Patent [19]

Lange

[11] 4,051,667

[45] Oct. 4, 1977

[54] CHAIN WELDING MACHINE

[75] Inventor: Gerhard Lange, Reutlingen, Germany

[73] Assignee: Wafios, Maschinenfabrik, Wagner, Ficker & Schmid (GmbH & Co. KG), Reutlingen, Germany

[21] Appl. No.: 665,804

[22] Filed: Mar. 11, 1976

[30] Foreign Application Priority Data

Mar. 11, 1975 Germany ..... 2510420
Sept. 30, 1975 Germany ..... 2543552

[51] Int. Cl.[2] ..... B21L 3/02

[52] U.S. Cl. ..... 59/31; 219/51; 219/120

[58] Field of Search ..... 59/31, 33, 34; 219/51, 219/120, 119, 101

[56] References Cited

U.S. PATENT DOCUMENTS

| | | | |
|---|---|---|---|
| 1,749,435 | 3/1930 | Lewis | 59/31 |
| 3,193,655 | 7/1965 | Weischede | 219/101 |
| 3,487,193 | 12/1969 | Width | 219/120 |

FOREIGN PATENT DOCUMENTS

| | | | |
|---|---|---|---|
| 425,026 | 5/1967 | Switzerland | 59/31 |

*Primary Examiner*—C.W. Lanham
*Assistant Examiner*—Gene P. Crosby
*Attorney, Agent, or Firm*—Wigman & Cohen

[57] ABSTRACT

A chain welding machine for the electrical resistance butt-welding of substantially C-shaped chain links is disclosed wherein two pair of electrodes are arranged symmetrically in relation to a median plane of the machine frame. Each pair of electrodes is supported on a pair of double-armed levers arranged for opposite rotation about a horizontal axis. Each electrode pair is adapted to grip, in plier-like fashion, one of the two ends of the chain link to be welded. Each lever pair is rotatably mounted to a trunnion which is, in turn, resiliently mounted in a bushing in the machine frame for absorbing any radial and/or axial loads imposed on the electrodes by misaligned or oversized chain links to be welded.

27 Claims, 14 Drawing Figures

CHAIN WELDING MACHINE

The invention concerns a chain welding machine for the electrical resistance butt-welding of more or less C-shaped chained chain links, with two pairs of electrodes installed symmetrically in relation to a median plane, each pair gripping one of the two ends of the chain links to be welded, and equipped with two two-armed levers, each activating one pair of electrodes. The said levers are installed back-to-back around horizontal and parallel axes which can rotate in a synchronous fashion, to a limited degree, as well as parallel and more or less perpendicular in relation to said axes, whereby the two levers provided for said pair of electrodes are mounted in a rotating fashion around the axis of a common pivot.

With one model of this type of machine which was mentioned in West German (DT-AS)-1 577 063, both pivot pins which are aligned on each side of the median plane for the raising and lowering of the electrodes can move and up and down vertically in relation to a common axis. Moreover, the levers can be pushed axially along the pivot pin.

Since, following the bending process, the link ends to be welded are not aligned perpendicularly in relation to the direction of the median plane and are separated by a specific minimum amount of space, as illustrated in FIG. 1, the two link ends to be welded move onto arches of the linking plane, around central points of the link arches, when the compressor steel which is applied to the link arches compresses the chain links to be welded along a straight line which is perpendicular in relation to the median plane and which runs along the linking plane, until the ends of the links touch one another over the entire end plane, and the welding process has ended. Here, the electrodes which act on the link ends to be welded must also move along the aforementioned arches or curves, as shown in FIG. 1, if, in view of the service life of the electrodes which results from the related wear, undesirable friction-related relative motion of the electrodes in relation to the link ends and penetration of the electrodes are to be prevented. However, this is basically not possible in the case of electrodes with only two degrees of freedom which are independent from each other. The irregularity and imperfection of the surface contact between the electrodes and the link ends to be welded can therefore cause damage to the machine and to the chain whose quality is reduced by the penetration.

The type of machine mentioned in the West German Patent Specification (DT-AS) 1,577,063 can also not prevent damages to the electrodes if the two link ends to be welded are not exactly on the same plane. In such cases, one of which is shown in FIGS. 2 and 3, the electrodes, in view of the rigid design of the levers with which they are equipped, cannot produce any deflection of the pivot pin.

The object of this invention is therefore to produce as simple a design as possible of the type of chain welding machine mentioned in the introduction, whose electrodes can be almost completely protected without the need for large expenditures, even if the ends of a chain link to be welded are laterally reversed, without this protection resulting in any additional costs with regards to the service life of other components of the machine.

One attempt to achieve this goal was made with the well-known chain welding machine represented in the West German Patent Specification (DT-OS) 2,123,560 in which ball-and-socketjoints were used. However, this machine is relatively complex and susceptible to trouble, and the required additional expenditure can therefore not be compensated for. Moreover, for the case of laterally reversed link ends of a chain link to be welded, the existing machine provides for the reversed condition to be corrected through forceful shaping of the chain link. This, however, is either impossible or damaging for the machine and/or chain link.

The goal of the invention is thus achieved in a totally different way, in that each pivot pin, for the pick-up of radial and/or axial load through the chain link to be welded, is arranged inside the bearing bush of the frame of the machine by means of rubber. In a surprisingly simple way, this permits each of the two pairs of electrodes to effect the above-mentioned necessary circular movement upon complete closure of the gap in the chain link to be welded, and to adapt itself to any possible laterally reversed link ends in order to prevent damages which would require regular replacement of the electrodes which, among other things, would require shut-down of the machine which, of course, is disadvantageous from the point of view of productivity. The axes of the pivot pins remain constantly parallel to the axes of the link ends to be welded. Moreover, there is no relative motion between the electrodes and the link ends to be welded. Nevertheless, the rubber bearing of the pivot pin serves as indirect automatic electrode carrier for the application and removal of the electrodes needed during and following the compression of the chain links to be welded.

We do know from the U.S. Pat. No. 2,317,962, that the electrodes of a chain welding machine can be loaded using rubber bands which are quite thin in relation to their surface, in order to improve the electrical contact between the electrodes and the link ends to be welded. However, as previously mentioned in the West German Patent Specification (DT-PS) 1,022,884, concerning this subject, the rubber plates do not sufficiently prevent the undesirable slipping of the electrodes on the link ends to be welded. For this reason, the use of rubber elements for loading the electrodes has been avoided for the machines known per West German Patent Specification (DT-PS) 1,022,884 and West German Patent Specification (DT-OS) 2,123,560.

In each of the aforementioned embodiments of the chain welding machine which is the aim of this invention, there is an antivibration ring unit installed in every bearing bush, whose outer metal ring is axially shorter than its inner metal ring. This type of ring unit provides the necessary bearing of the pivot pin, by means of said antivibration ring, in a simple, durable and effective way. The minimum one ring unit is installed between two guard rings affixed inside the bearing bush, whose inner diameter is considerably larger than that of the pivot pin, This serves both to facilitate the assembly and ensure that the movement of the pivot pin in every direction is only controlled by the ring unit itself, and not limited by other components of the machine. As it is the case with the aforementioned embodiments of the machine, when several ring units are used, in intermediate ring is then installed between the outer metal rings of two adjacent elements, so that the outer metal rings are locked in position. The latter is totally responsible for movements in all directions.

Moreover, the aforementioned embodiments provide for both levers installed on the said pair of electrodes to be attached by means of trunnion bearings whose loop-shaped trunnion halves are geared and on which the part of the pivot pin which faces the median plane or projects from the bearing bush are installed in a rotating fashion. The two trunnion bearings associated with each pair of levers create an exact guide for the associated pivot pins, without any danger of twisting. The movement of each pair of levers as well as their related pivot pins is greatly limited by the elasticity of the intermediate rubber rings.

With one of the previously-mentioned embodiments, it is foreseen that the inner axial distance between the two trunnion halves of each trunnion bearing be larger than the axial thickness of the trunnion halves of each other trunnion bearing, in order to improve the movement without there being any danger of excessive tipping of the pair of levers, and that an additional ring element be installed between the two inner trunnion halves of various trunnion bearings with the outer metal ring of said ring element lying on an inner flange which, with this type of embodiment, lies approximately of the median plane, for example extended bearing bushes, and whose inner metal ring, on the one hand, lies on a modified outer shoulder of the pivot pin on the median plane, and, on the other hand, lies on the bushing which extends all the way to the tension plate, and without the trunnion halves of the different sides, installed between the additional ring element and the tension plate whose outer diameter is considerably larger than the inner diameter of the bearing bush resting against the aforementioned bushings urging the bearing bushings from every side, through radial penetration.

The previously-mentioned embodiments of the machine, in accordance with the invention, can, as specified in West German Patent Specification (DT-PS) 1,022,884, be provided with a double-action cylinder-and-piston aggregate installed on each pair of levers, activated by the closing and opening movement of the electrodes of each gear-type pair of levers. In this case, in order to, on the one hand, create the symmetray of the lever movement in relation to a vertical plane which contains the axis of the related pivot pin, without on the other hand interfering with the axial movement of the pair of levers required for the application of the electrodes during the compression of the link ends to be welded, the previously-mentioned embodiments are essentially identified by the fact that the free end of the piston rod on the aggregate is articulated onto one of the two levers with which the said pair of electrodes is provided, and that the aggregate cylinder is articulated onto the second lever. Here, moreover, two of the straps attached to the levers are joined in an articulate fashion by means of a pin which is mounted perpendicularly in relation to the median plane, with said pin running through a vertically-extending slot made of electrically non-conductive material, consisting of a guide plate fitted onto the frame of the machine.

The aforementioned embodiments moreover provide for the levers with which the two different pairs of electrodes are provided and which are installed symmetrically in relation to the median plane to be connected by means of a rod mounted onto one of the two levers by means of a casing made of electrically non-conductive material, and two isolated plates made of a similar material and installed freely on the other end of the levers, whereby a helical spring is provided to meet the pressure requirements, with said spring resting on one side against the rod, and on the other side against the other lever. The front and back helical springs serve to balance out tipping forces resulting from the flexible arrangement of the pairs of levers, and assist in preventing these from bending towards each other and towards the median plane.

With the previously-mentioned embodiments, each of the two bearing bushings is installed in the pick-up head of a diagonal lever which is mounted indirectly onto the frame of the machine in a rotating fashion, and which can periodically be swung back and forth by means of a curve control mechanism. As we already know from West German Patent Specification (DT-PS) 1,022,884, the curve control mechanism appropriately consists essentially of a curve control cam and a roller which runs on the peripheral surface of said cam, with said roller installed on one arm of the diagonal lever which carries one of the bearing bushings with its pick-up head. If the curve control cam, together with the roller, produces the two halves of an electrical contact which affects the control switching for the automatic turn-off of the machine, we can then be sure that in the case of an insufficient lowering of the electrodes, for any reason, the electrical contact will be interrupted and the machine will be turned off so as to permit the cause of the breakdown to be removed, and any possible damages to be repaired.

It would be desirable, as in the case of the referenced embodiments, to provide for a manually-operated device to be included for shifting the two pairs of levers to an axial direction perpendicular to the median plane to permit the electrodes to be applied to any desired area of the link ends to be welded, which is especially useful in the case of link ends of varying lengths. As described in the beginning of this specification, the existing machines with limited movement of the levers are not able to prevent damages to the electrodes if the two chain link ends to be welded are not exactly aligned, i.e. they are not exactly on the same plane. From the foregoing discussion, it will be seen that the flexible rubber arrangement of the pivot pin in a bearing bushing quasi affixed to the frame cannot make bending errors and other geometrical defects of the chain links to be welded on a rod acceptable, whether it be quantitywise or qualitywise.

It can be seen from FIG. 9 that with a degree of variability of the wire diameter of the chain link of $a$, the height difference of the chain links welded on a fixed saddle is doubled, i.e. $2a$, if a great variation in the degree of bending of the chain link ends to be welded is ignored. This height difference, as shown in FIG. 10. results in the two electrodes of each pair of electrodes, other than as far as the average height of the chain links to be welded are concerned, sometimes having to be applied higher and sometimes lower. The maximum height difference, however, is not always compensated for by the rubber bearing of the electrode-carrying levers, not any more than an excessive opening of the link ends, as shown in the right-hand side of FIG. 11, due to tolerances in the rigidity of the wire which depends greatly on the strength of the wire and on the wire material, or due to unprecise adjustment or wear of the bending tools used. The example shows how a normal link with dimension $b$ is followed by an expanded link with dimension $b + \Delta b$, whose height differs from the normal link by $\Delta b$. If $\Delta b$ is too large, the rubber bearing of the electrode lever fails.

The lever to which the electrode carrier depresses following transportation to the saddle of the chain link which is to be welded next is, as usual, determined by an adjustable stop affixed to the frame, whose adjustment must be such that the electrodes are still above the chain links at the minimum height which can be expected (height above the saddle). Now, if a broader chain link is to be welded, the electrodes together with their carrying superstructure which is no longer affected by the stop, run freely over the link ends, whereby the electrodes and their pick-ups are instantly used up for the link curves.

The aim of the invention is therefore to provide a chain welding machine with possibly translatory fixed levers, but more specifically, a machine in accordance with the above-mentioned solution, whose electrodes are almost totally protected without the need for any great expenditure, even if the ends of the chain links to be welded were unevenly bent or shaped and/or are at a different height above the welding saddle, without this protection resulting in any losses as far as the service life of other machine parts is concerned. In accordance with the invention, this goal is achieved by the fact that each electrode has a fixed part in relation to the lever which moves them, with a first operative and sliding plane which lies on a level which is parallel in relation to the chain links to be welded, and a second operative and sliding plane mounted on rubber bearings, at least as far as one direction is concerned, which is parallel in relation to the chain link plane and to the median plane and moves in relation to the fixed part, and which picks-up the chain link to be welded, acting in conjunction with the first operative and sliding plane. The ideal combination, here, has been found to be the combination with rubber bearing mounting of the levers which carry the pairs of electrodes. The division of each electrode into one fixed part and one mobile part permits the automatic adjustment of the electrodes to the varying height of the chain link ends to be welded. It may happen that this mounting of the lever on rubber bearings does not suffice to solve the above problem.

One type of chain welding machine was introduced by U.S. Pat. No. 3,131,282, whose circle segment-shaped carbon electrodes, only one of which is assigned to each chain link end, are installed in a rotating fashion around a parallel axis, onto a section which can rotate to limited degree around an axis which is perpendicular in relation to the plane of the chain links to be welded, so that the pick-up of the link ends occurs automatically. However, in view of the limited movement of the rotating parts, only a limited adaptation of the electrode adjustment to the varying size of the chain links is possible. Going from a specific size (height above the saddle), the electrode can no longer move in the direction in which the size of the link is to be measured. A failure of the carbon electrodes is then unavoidable. If copper were used for the electrodes, the pick-up of the electrodes for the chain link ends would be distorted and the circuit would be interrupted, at which point penetration and defective welding would result. The known partial solution to the problem is therefore inadequate, at least from a quantitative point of view. This inadequacy cannot be resolved by increasing the rotating area of the carbon electrode carrying parts, because such an extension would result in each of the two electrodes which remain in the space reached, in the case of an abrupt change of dimension of the chain link, especially with regards to its height, would no longer be able to adjust automatically. On the other hand, the rubber bearing of the mobile parts of each electrode with the machine in accordance with the invention, ensures that the said mobile part, after its release and discharge, returns to its normal pick-up position.

A cooling of the electrodes now made exclusively of copper and reaching very high degrees of temperature is not only desirable, but also necessary. With the aforementioned embodiment of the machine in accordance with the invention, each electrode is therefore provided with two tubular flexible (elastic) parts, one end of which is in fluid-conducting connection with a channel for the cooling medium in the mobile part of the electrode, and the other end with an inlet and discharge channel built-in in its stationary part, or a returning channel for the cooling medium. The possibility of cooling down the electrodes therefore does not impede their movement, at least not as far as their movement parallel to the median plane of the machine and to the plane of the chain links to be welded, which both normally run vertically.

Advantageously, with the aforementioned embodiment, the side piece of the flexible part which carries the mobile part in the area of the mobile part is interrupted by a soluble tube connection. This permits the mobile parts of the electrodes to be easily exchanged for parts fitting chain links of other sizes. In order to ensure that the installation of the mobile part of each electrode onto the fixed part remains intact, even under extreme tipping of the mobile part, the recommended embodiment provides for the first operative and sliding plane of each electrode to be constructed onto one end of its mobile part which extends especially in the main direction of movement of the mobile part of the electrode. This also ensures that the second operative and sliding plane constantly remains in contact with the mobile part of each electrode.

In the following paragraphs, the invention is described and illustrated by three embodiments of the chain welding machine in accordance with the invention. These are individually described.

Figure 1:
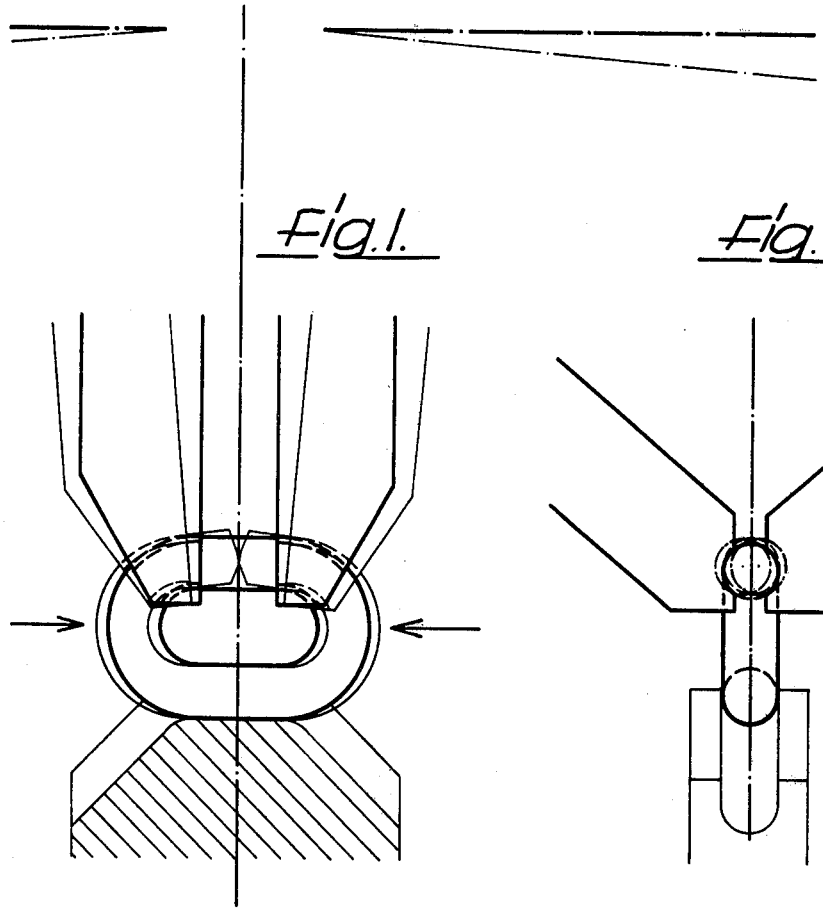
FIG. 1 is a side view of a chain link to be welded showing a non-alignment condition of the chain link ends.
Figure 3:
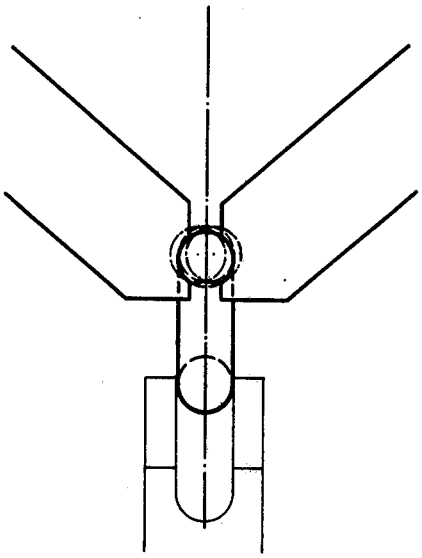
FIG. 3 is an end view of the chain link of FIG. 2.
Figure 2:
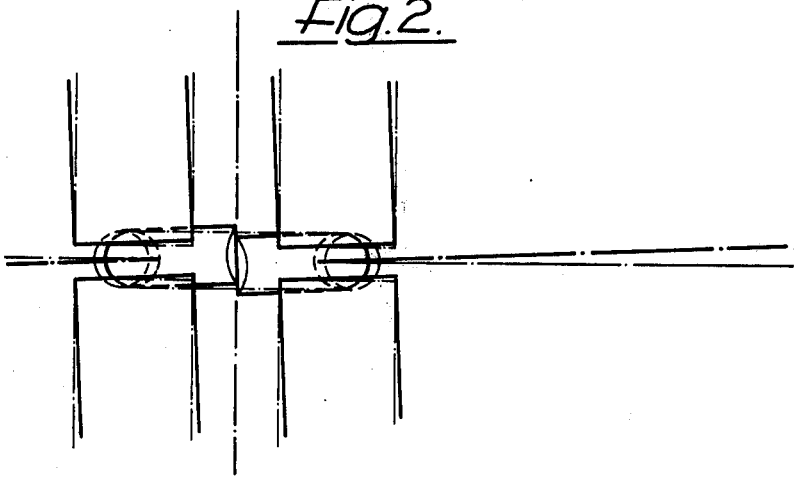
FIG. 2 is a top view of a chain link to be welded showing another non-alignment condition of the chain link ends.
Figure 4:
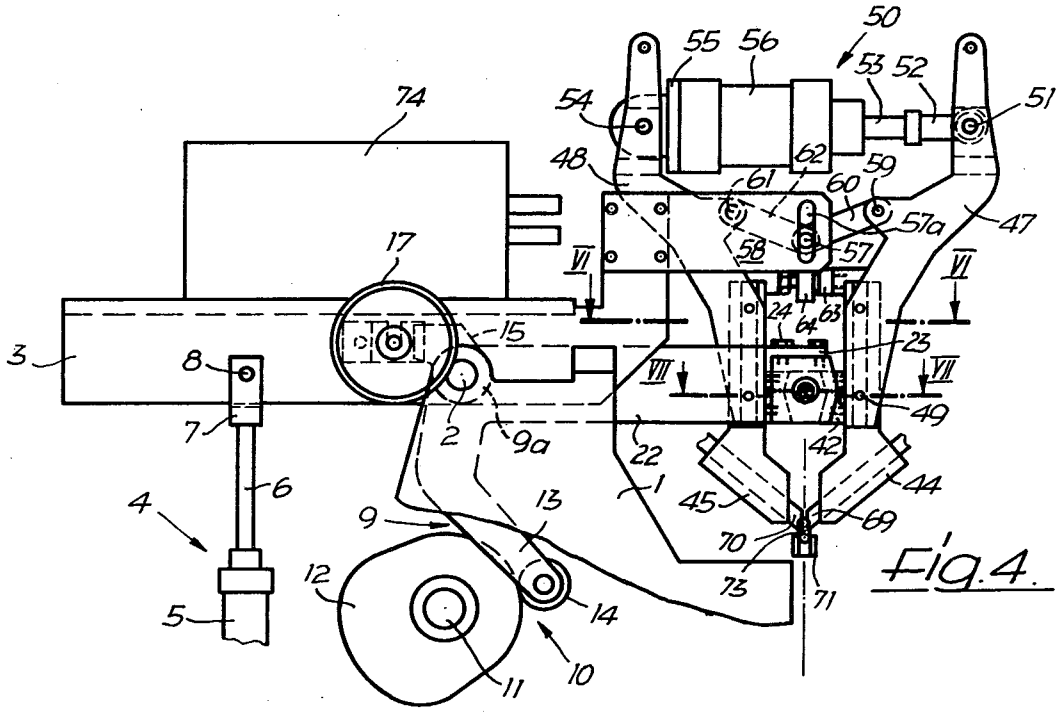
FIG. 4 is a side view of part of a first and second embodiments.

The first and second embodiments are built more or less symmetrically in relation to their median plane M which is identified by a straight line in FIGS. 5 to 8. As long as symmetry prevails, the following description shall only apply to one half of the machine; however, it does apply correspondingly to the second half of the machine. The machine frame 1 is provided with a device 3 mounted onto a rotating axis 2 with said device 3 having the capability of being swung upward with the help of of a cylinder-and-piston aggregate 4 as illustrated in FIG. 4, to the left of the rotating axis 2, the cylinder 5 of which is attached in a rotating fashion onto the machine frame 1 with its end which is not shown here, and the piston rod 6 of which is articulated onto the device 3 by means of a rod head 7 and a bolt 8, in accordance with the procedure described in detail in West German Utility Model Patent Specification (DT-GMS) 7,023,450 for changing or replacing individual parts, and illustrated in FIG. 4 of said patent. On both sides of the median plane M of the rotating axis 2, a diagonal level 9 is installed which can rotate and and slide as necessary. Each diagonal lever 9 is rotated by a curve control gear 10 which is provided with a curve control cam 12 which is mounted on a camshaft 11 installed on the frame 1 and which acts in conjunction with a roller 14 which runs along its periphery and is installed on the forked end of a first forcibly moved arm 13 of the diagonal lever 9. This combined action thus power-controls and guides the diagonal lever 9. Each hub 9*a* of both diagonal levers 9 is provided with a platelike cam 15 which grips onto the forked end of a guide 18 which is moved by means of a pivot 16 and a hand-wheel 17. A guide plate 19 attached to the frame 1 grips onto a circular groove 20 of the pivot 16 which is installed in a rotating fashion onto the frame 1, and axially blocks said spindle. The guide 18 runs in fixed rotation on a guide pin 21. By adjusting the hand-wheel 17, the position of the two diagonal levers 9 in relation to the median plane M can be changed. The parts 15 to 21 thus form an adjusting device for each diagonal lever. The second arm 22 of both diagonal levers 9 is provided with a pick-up head 23 on its free end, to which a bearing bushing 25 is attached by means of screws 24. In said bearing bushing 25, in accordance with the first embodiment illustrated in FIGS. 4 to 7, the end 26 of a pivot pin, which faces away from the median plane M is elastically mounted by means of three antivibration ring units 28 made of rubber and steel. Each ring unit consists of one intermediate rubber ring 28*a* with a trapezoidal cross-section, and a shorter, outer steel ring 29, as well as another but longer inner steel ring 30, both steel rings 29 and 30 being formed in one piece with the rubber ring 28*a*. The three ring units 28 are arranged between two securing rings 34 anchored in the bearing bushing 25, whose inner diameters are considerably larger than that of the pivot pin 27. An intermediate ring 32 is installed between each outer metal ring 29 of the three ring elements 28. Moreover, an axially secured fixed tension plate 36 rests against the pivot pin, against which the ring elements 28 are urged. A tension and release nut 40 is screwed onto the end of the pivot pin 27 which faces away from the median plane M, which serves to control the tension of the ring elements 28 against the tension plate 36 by means of two adjacent intermediate bushings 38 and 39 installed on the pivot pin 27.

On the end 41 of the pivot pin 27 which lies nearest to the median plane M and which is provided with an end flange 81, fork bearings 42 and 43 are mounted in a rotating fashion, each of which is connected to an electrode carrier 44 and 45 by means of screws 46. On the electrode carriers 44 and 45, there are screws 49 screwed-in so as to form a pair of levers 47 and 48.

The tension plate 36 has an outer diameter which exceeds the inner diameter of the bearing bushing 25 and lies inside an additional outer shoulder 35 of the pivot pin 27, in the bearing bushing 25, as well as one of the forked halves of the fork bushing 43. Between the bearing bushing 25 and the tension plate 36, an insulating plate 37 with an appropriate diameter and made of an electrically non-conductive flexible material rests against the pivot pin 27.

The levers 47 and 48 connected with a pair of electrodes are connected to each other at their upper ends by means of a cylinder-piston aggregate 50, whereby the lever 47 is connected by means of a bolt 51 and a pole eyelet 52 with the piston pole 53 and the lever 48 is connected by means of a bolt 54 and a swivel bearing 55 with the cylinder 56 of the aggregate 50.

In order to ensure that, when the piston of the aggregate 50 is loaded, the two levers 47 and 48 trace a symmetrical movement in relation to the plane containing the chain link 73 to be welded, which plane is vertically perpendicular to the median plane M, said levers are of parallel construction. For this, a bolt 57 slides in an oblong slot 57*a* of a guide plate 58 of electrically-insulating material, connected with the assembly 3. The bolt 57 is attached to a cover plate 60 fastened movably to a bolt 59 on the lever 47. Another cover plate 62, fastened movably on one side to a bolt 61 on the lever 47, is fastened on the other side so that it swivels to the bolt 57. Two cooperating stops 63 and 64 located on the levers 47 and 48 limit the stroke of the cylinder-piston aggregate 50 when the aggregate piston 50 is loaded in the direction which urges the upper ends of the two levers 47 and 48 closer together.

Figure 5:
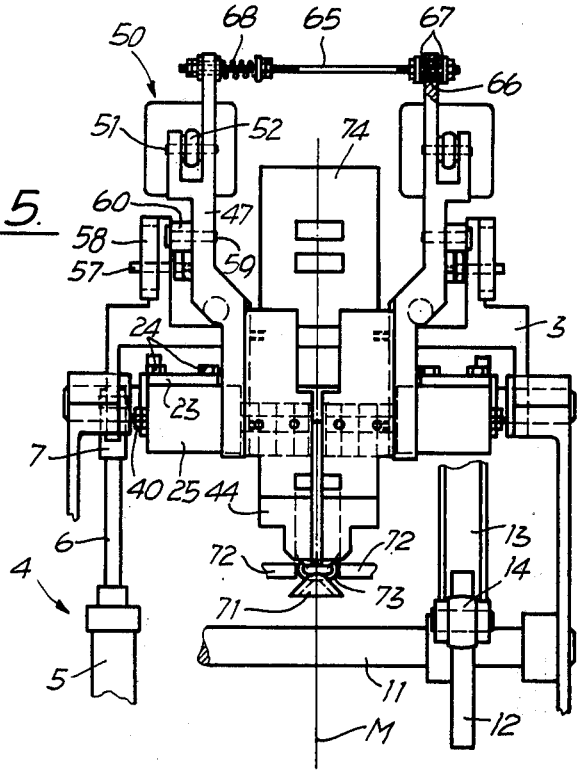
FIG. 5 shows a front view of the same part of the first embodiment.
Figure 6:
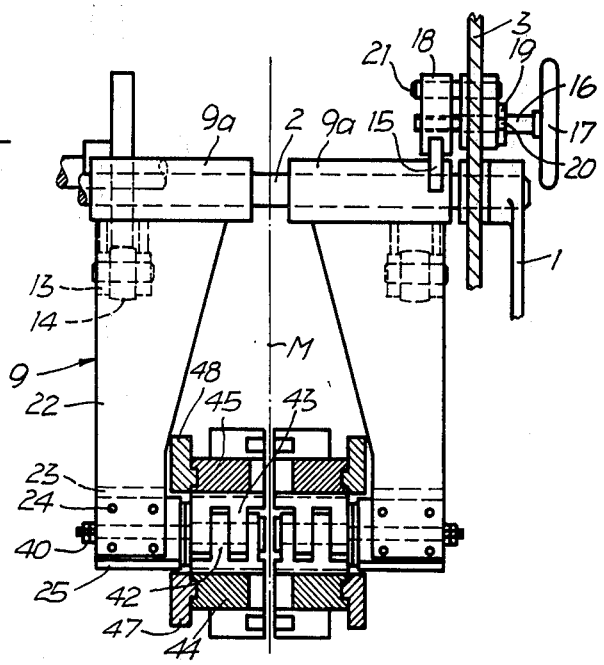
FIG. 6 shows a broken horizontal cross-section according to line VI—VI of FIG. 4, through the first embodiment.
Figure 7:
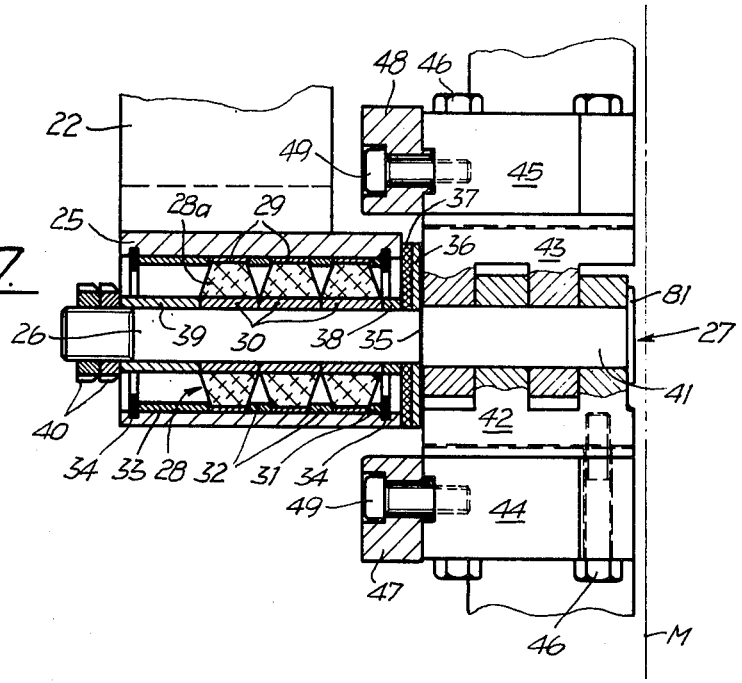
FIG. 7 shows a 90° clockwise rotated broken horizontal cross section according to Line VII—VII of FIG. 4, through the embodiment.

The upper ends of the two symmetrically-arranged forward levers 47 and the two symmetrically-arranged rear levers 48 are connected movably by means of a rod 65, which is attached fixedly to the lever shown to the right of the median plane M in FIG. 5, but insulated by means of a sleeve 66 and disks 67 made of electrically non-conductive material. The rod 65 is fastened to the lever to the left of the median plane M in such a way that it can move freely at least to a limited degree in all directions, whereby a spiral spring 68, adjusted functionally between the rod 65 and the left lever, equalizes the maximum torque originating from the elastic mounting of the electrode holders 44 and 45 on the bush 25.

At the lower end of the electrode holders 44 and 45, electrodes 69 and 70 are arranged symmetrically and at a diagonal to the plane containing the chain link 73 to be welded. Each of the two electrode pairs 69–70 partially embraces one of the link ends to be welded (free side) of the chain link 73 standing upright on a saddle 71, held by compressing tools 72, from either side of the said plane.

The assembly 3 includes a welding transformer 74, the secondary winding terminals of which are connected with the pairs of electrode holders by means of conduction bands, not shown in the figures.

The operating principle of the first embodiment described is as follows:

Following the conveyance of the next chain link 73 to be welded into welding position according to FIG. 5, and after the compression tools 72 have been put in contact with the link rounded ends with the appropriate contact pressure, holding the link firmly centered on the saddle 71, the electrode holders 44 and 45, which had been raised previously for the transport of the chain, are lowered into working position by means of the cam gears 10, so that the two pairs of electrodes 69–70 do not yet lie sideways against the chain link 73. Now, the piston of each cylinder-piston aggregate 50 is acted upon in such a way that the electrode holder pairs 44 and 45, connected with the trunnion bearings 42 and 43, move around the common axis of the trunnion 27 as a result of the closing movement of the levers 47 and 48, until the electrodes 69 and 70 grip the link ends in the manner of pliers on every side of the median plane M in which the link is contained.

Because of the relatively long and very stable design of the trunnion bearings 42 and 43, and their arrangement on the trunnion 27, the contact surfaces of the electrodes of any pair are always parallel to one another in contact with the link end, even in the case of very high contact pressure.

As a result of the parallel construction in the guide plate 58, the bolts 57 and the cover plates 60 and 62, the electrodes 69 and 70 execute a symmetrical, synchronous movement on the link end.

Figure 8:
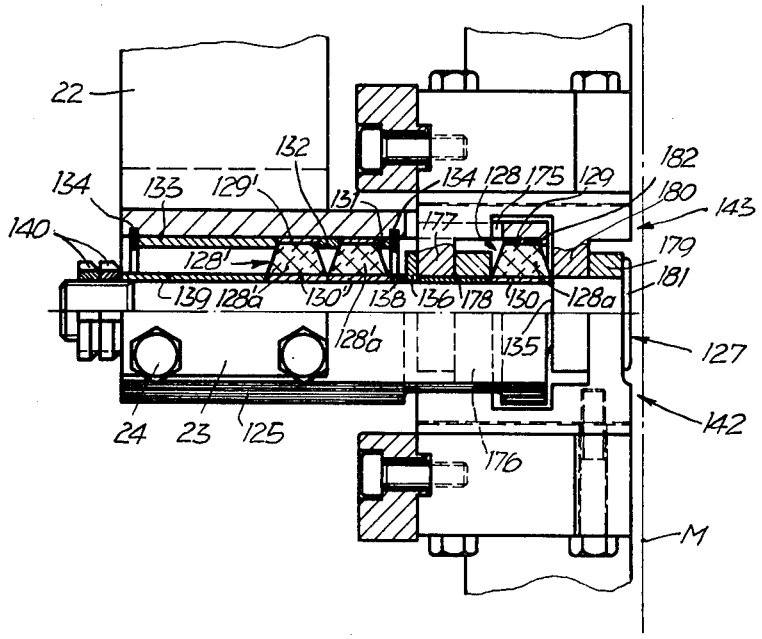
FIG. 8 shows a partial representation of a second embodiment corresponding to FIG. 7.

In the case of the second embodiment, according to FIG. 8, there is a bush 125 attached by means of screws 24 to the take-up head 23 of the toggle lever arm, said bush being half again as long as the median plane M. It has two openings 175 into which the fork halves 176 and 177 of two trunnion bearings 142 and 143, located at a distance from the median plane M, project from outside. The adjoining fork halves 176 and 177 are on a common sleeve 178, which in turn is fastened onto the smaller diameter section of a trunnion 127 fitted with an outer shoulder facing the bush 125. The adjoining fork halves 179 and 180, which are closer to the median plane M, are located directly on top of the thicker section of the trunnion 127. Between the fork halves 176 and 177 on the one hand and the fork halves 179 and 180 on the other, a rubber-steel ring element 128 is fitted into a suitable interspace, which element is tightened over the sleeve 178 against the outer shoulder 135 of the trunnion 127 along with two other identical ring elements 128', shown to the left of the fork halves 176 and 177 in FIG. 8, with steel inner rings 130', by means of a fixed tightening disk 136 located on the trunnion 127 and adjacent to the sleeve 178 said disk having a relatively smaller outer diameter than the tightening disk 36 FIG. 7, as well as by means of intermediate sleeves 138 and 139 and a tightening and check nut 140. By joining a terminal flange 181 on the trunnion 127, next to the median plane M, to the fork half 179 and the tightening disk 136 to the fork half 177, the trunnion 127 is secured against axial displacement in the trunnion bearings 142 and 143. The two steel outer rings 129' of the ring elements 128' are fastened axially in the bush 125 through the intermediary of intermediate rings 131, 132, 133, by means of securing rings 134. The bush 125 is equipped with an inside flange 182 on the end facing the median plane M, to which flange the steel outer ring 129 of the ring element 128 is adjacent.

In other particulars, the second embodiments coincides in principle with the first embodiment as concerns design and operating principle.

Figure 9:
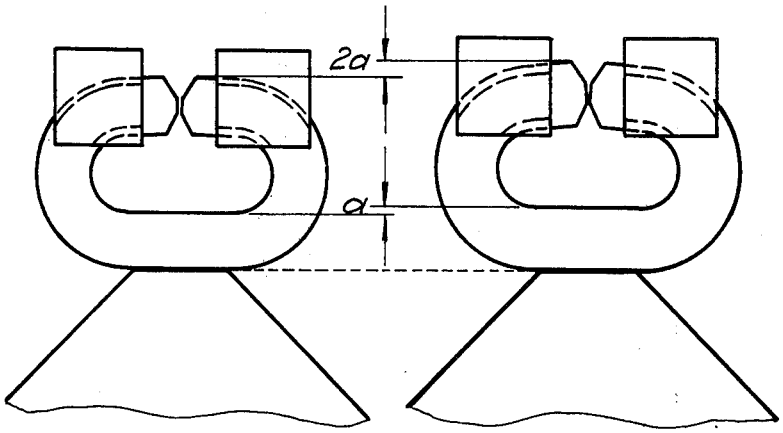
FIG. 9 is a side view showing the height difference of chain links of varying wire diameter.
Figure 10:
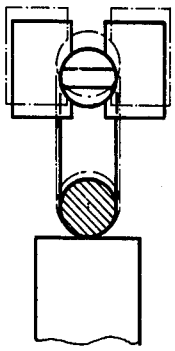
FIG. 10 is a cross-sectional end view of the chain links of FIG. 9.
Figure 11:
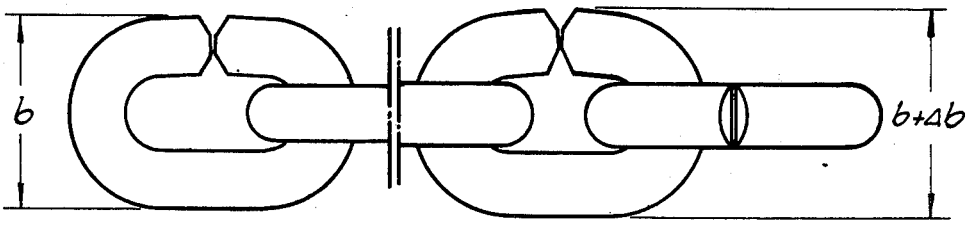
FIG. 11 is a side view showing the height difference of chain links bent from wire of varying rigidity or with improperly adjusted or worn bending tools.
Figure 12:
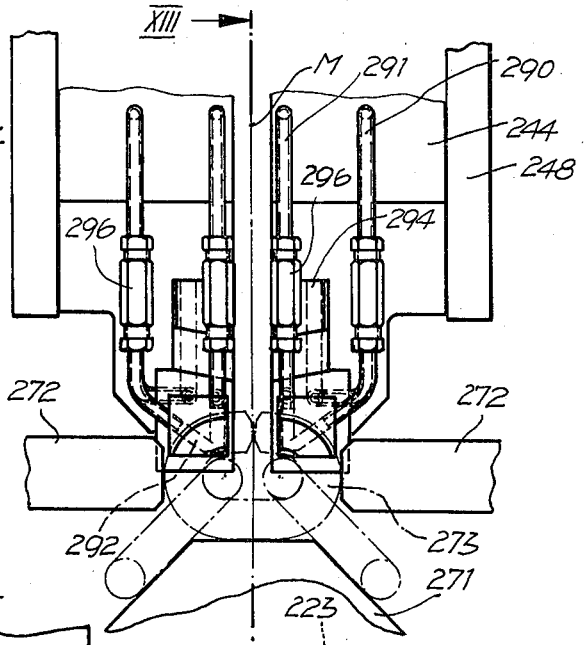
FIG. 12 shows a front view of the greatest part of the third embodiment.
Figure 13:
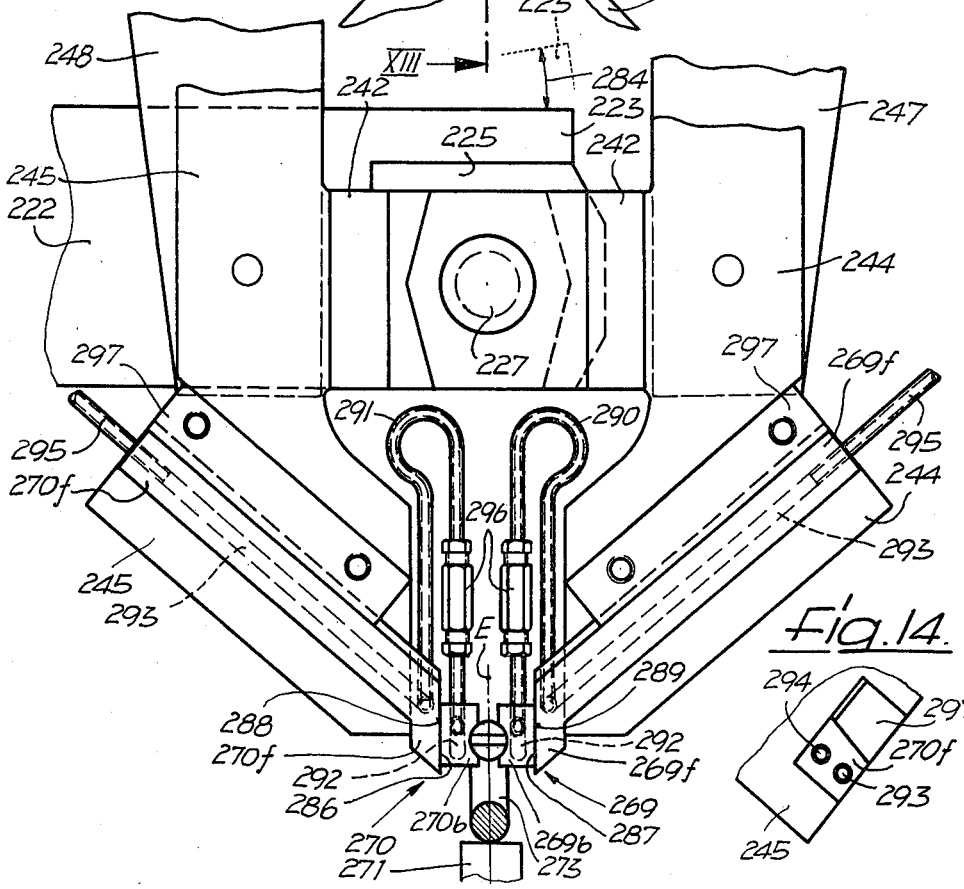
FIG. 13 shows a cross-section in accordance with Line XIII—XIII of FIG. 12, through the third embodiment.
Figure 14:
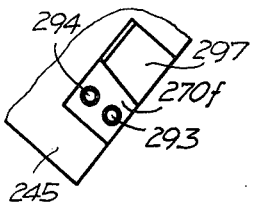
FIG. 14 shows a top view of an individual characteristic of the third embodiment of the invention.

The third embodiment, which is intended for correcting defects in the chain links as shown in FIGS. 9 through 11 is constructed as described above, insofar as it is not indicated otherwise in FIGS. 12 through 14. Where differences do exist, we refer expressly to the detailed description of the first embodiment.

A cam gear (not shown) moves the first arm of a double-armed lever attached to rotate on the machine frame, the second arm 222 of which thus executes a swiveling movement in the direction of the arrow 284 when the cam gear is activated. Located at the free end of the arm 222 is a take-up head 223 for a bush 225, in which a trunnion 227 is fitted for the uptake of a radial and/or axial loading by the chain link to be welded; said trunnion is attached in such a way that it is elastic like rubber. Two electrode holders 244 and 245, attached to the lower arm of a two-armed lever 247 and 248, are fastened to the trunnion 227 by means of trunniong bearings 242 so that they rotate around the horizontal axis of the trunnion and so that the two levers that move the pairs of electrodes can be rotated in opposite direction and synchronously. The lower arms of the levers 247 and 248 visible in FIG. 13 thus support the electrode holders 244 and 245, tilted on the bottom by less than 45°, which carry the stationary parts **269*f* to 70*f* of electrodes 269 and 270, which part is clamped by clamping shoes. The lower ends of the stationary electrode parts, which are adjacent to the saddle 271 supporting the chain link 273 to be welded are enlarged chiefly in vertical direction, so that their facing sides form first contact and sliding surfaces 286 and 287, which lie in planes parallel to the vertical plane E of the chain link 273 to be welded. The two electrodes 269 and 270 have two parts 269*b*, 270*b* that move in relation to the stationary parts 269*f*, 270*f* and take up the chain link 273 to be welded, and the facing sides of which have smooth contact and sliding surfaces 288 and 289 that interact with the first contact and sliding surfaces 286 and 287. The parts 269*b* and 270*b* are elastically attached and movable in a direction parallel to the chain link plane E and the vertical median plane M (FIG. 12) in that they are connected with the enlarged ends of the appropriate stationary parts 269*f* and 270*f* by means of two elastic parts 290 and 291. The two elastic parts 290 and 291 on the respective electrode 269 or 270 are approximately hairpin-shaped, and arranged more or less in two planes parallel to the median plane M, whereby there is symmetry with relation to the chain link plane E. The elastic parts 290 and 291 are tube-shaped, one end of which is connected to conduct fluid with a cooling agent channel 292 in the movable part 269*b*, 270*b* of the appropriate electrode, and the other end of which is connected in the same manner with an influx and reflux channel 293 and 294 for cooling agents in the stationary parts 269*f*, 270*f*. These connections are made fluid-tight by soldering the tube ends into the electrode parts. The cooling agent channels 292 are approximately V-shaped, as best seen in FIG. 12, while the influx and reflux channels 293 and 294 are straight. Attached to them are cooling agent ducts 295. The arm of the elastic part 290 or 291 carrying the movable parts 269*b*, 270*b* of each electrode is interrupted in the area of the movable part by means of a detachable pipe-joint connection 296, so that the movable parts 269b, 270b** of the electrodes can be exchanged for adjustment to the chain link dimensions.

In the present, a description of only one half of the machine was given. The other half is symmetrical to this first half in relation to the median plane M, and is thus a mirror-inverted copy of what has been described above. The vertical median plane M that is perpendicular to the plane E of the chain link 273 to be welded divides the two pairs of electrodes, each of which grips one of the ends of the chain link 273 to be welded in the manner of pliers.

The operating principle of the third embodiment is as follows: After the next chain link 273 to be welded has been moved into welding position on the saddle 271 and two compressing tools 272 (FIG. 12) have come into contact with the link roundings with the appropriate contact pressure, the pairs of electrodes, previously raised for the movement of the chain, are lowered into working position, in which the movable parts 269b, 270b of the electrodes 269 and 270 of each pair are not yet in contact with the appropriate link end. Only when the electrode holders 244 and 245 are swiveled toward each other around the axis of the trunnion 227 do the movable parts come into contact with the link ends, centering themselves. The continuing alignment results in that the movable parts 269b, 270b of the electrodes move relative to their stationary parts 269f, 270f, whereby the contact and sliding surfaces 286 and 287 on the one hand and 288 and 289 on the other interact. The self-centering of the electrodes on the chain link to be welded, which is due to the division of the electrodes and the inserted elastic parts 290 and 291, can be superposed by a relative movement of the stationary electrode parts, not identical to the swiveling movement of the electrode holders around the axis of the trunnion, but common and in the same direction, to the arm 222 with its tape-up head 223. After complete alignment of the movable electrode parts and the end of the plier movement of the levers 247 and 248, there is close electrical contact between the movable and the stationary part of each electrode such that the passage of the current is almost identical to that in an undivided electrode.

I claim:

1. A chain welding machine for the electrical resistance butt-welding of inter-linked chain links bent into approximate C-shape comprising:

a machine frame having a vertical median plane;

two bushings mounted to said machine frame along horizontal axes and symmetrically with respect to said median plane;

a trunnion disposed in each bushing;

means resiliently mounting each trunnion in its respective bushing along the horizontal axis thereof;

two pair of double-armed levers arranged symmetrically with respect to said median plane, the levers of each lever pair being rotatably mounted to a respective one of said trunnions for rotation in opposite directions about the axis of said respective trunnion; and an electrode supported by each lever and arranged to grip a respective one of the two ends of the chain link to be welded in a plier-like manner.

2. The machine according to claim 1 including a rod connecting one lever of a lever pair to a corresponding lever of the other lever pair, the connection of the rod with said one lever being electrically insulated from said one lever, and the connection of the rod with said other lever being movable, the last-mentioned connection including a spiral spring arranged between said rod and said other lever.

3. The machine according to claim 1, wherein said resilient mounting means includes at least one ring element mounted to the trunnion in each bushing, said ring element comprising an outer ring and an inner ring, the outer ring having a shorter axial dimension than said inner ring, and an elastomeric ring interposed between and formed in one piece with said inner and outer rings.

4. The machine according to claim 3, wherein said elastomeric ring has a trapezoidal cross-section and said inner and outer rings are metal.

5. The machine according to claim 3, wherein each of said at least one ring element is arranged between a pair of securing rings affixed interiorly to its associated bushing, the inside diameter of said securing rings being substantially greater than the outside diameter of the trunnion in said associated bushing.

6. The machine according to claim 3, including a plurality of ring elements mounted to the trunnion in each bushing and further including intermediate rings disposed between the outer rings of said adjacent ring elements.

7. The machine according to claim 3, including a plurality of ring elements mounted to the trunnion in each bushing and further including a tightening disk axially affixed to each of said trunnions and against which said ring elements are tightened.

8. The machine according to claim 7, including tightening nuts threadably affixed to the outermost ends of said trunnions directed away from said median plane, intermediate bushings arranged about said trunnions between the tightening disks and the inner rings of the innermost ring elements and between the tightening nuts and the inner rings of the outermost ring elements, whereby said tightening nuts are inwardly threaded onto said trunnion to tighten the inner rings of said ring elements and intermediate bushings against said tightening disk.

9. The machine according to claim 1, wherein a portion of said trunnions project out of their respective bushings toward the median plane of said machine frame, each of said double-armed levers including a forked trunnion bearing, the forked trunnion bearings of the levers of each lever pair being intermeshed and rotatably mounted to said portion of their associated trunnion projecting toward said median plane.

10. The machine according to claim 9, including a tightening disk axially mounted to each of said trunnions, the ends of said trunnions facing said median plane having end flanges, the forked trunnion bearings of each lever pair being axially secured on their respective trunnion by the tightening disk and end flange of said respective trunnion.

11. The machine according to claim 10, wherein said tightening disk has an outer diameter greater than the internal diameter of its respective bushing, one axial side of the tightening disk bearing against an annular shoulder on the trunnion and one of the forked trunnion bearings, and including an insulating disk formed of electrically non-conductive material disposed on the trunnion between the bushing and the tightening disk.

12. The machine according to claim 10 wherein the intermeshing forked trunnion bearings of a lever pair extend radially into openings on opposite sides of the bushing and define an axial space along the trunnion intermediate the opposite ends of the bearings, and including a ring element having an outer ring and an inner ring and arranged about the trunnion in said axial space, said outer ring bearing against an internal flange on the bushing, said inner ring interposed between and bearing against an annular shoulder on the trunnion and a sleeve on the trunnion extending to the tightening disk, said tightening disk having an outer diameter smaller than the inside diameter of the bushing.

13. The machine according to claim 1, including a double-acting piston and cylinder connected with each pair of levers, said piston being pivotally connected to one lever of a pair and said cylinder being pivotally connected to the other lever of said lever pair, vertical guide plates formed of electrically non-conductive material and secured to the machine frame adjacent each lever pair, said guide plates each having an elongated opening therein, cover plates pivotally secured to each lever, the cover plates of each lever pair being pivotally connected to each other by a bolt arranged along a pivot axis perpendicular to the median plane, the bolt being guided in the elongated opening of the guide plate.

14. The machine according to claim 13, including stops arranged on each lever pair for limiting the stroke of the double-acting piston and cylinder when loaded in the direction which urges the upper ends of the lever pairs toward one another.

15. The machine according to claim 1, including two angle levers rotatably mounted to the machine frame, cam means for periodically rotating said angle levers back and forth in a plane parallel to said median plane, each angle lever having a first arm, the free end of which is provided with a pick-up head, said two bushings being mounted in a respective pick-up head.

16. The machine according to claim 15, wherein said cam means includes cam disks affixed to a camshaft mounted to the machine frame, a roller connected to a second arm of each angle lever and arranged to bear against the periphery of a respective cam disk.

17. The machine according to claim 16, wherein said cam disks and rollers comprise electrical contacts connected electrically with automatic means for stopping the operation of the machine.

18. The machine according to claim 1, including manually operable means for axially shifting said lever pairs relatively toward and away from the median plane of the machine frame.

19. The machine according to claim 18, wherein said manually operable means is operatively connected to each of said angle levers.

20. The machine according to claim 19, wherein said manually operable means includes a spindle rotatably mounted to the machine frame, a handwheel attached to one end of said spindle and a pin guide threadably attached to the other end of said spindle for axial movement therealong when said handwheel is rotated, said pin guide engaging a projection on one of said angle levers.

21. The machine according to claim 20, wherein the angle levers and manually operable means are arranged on an assembly rotatably supported on the machine frame, a welding transformer mounted on said assembly for supplying welding current to the electrodes and piston-cylinder means interconnecting said frame and assembly for swiveling said assembly relative to the frame.

22. The machine according to claim 1, wherein the chain link to be welded lies in a vertical plane perpendicular to said median plane, each electrode comprising a first electrode part affixed to an associated double-armed lever, said first part having a sliding contact surface lying in a plane parallel to the vertical plane of the chain link to be welded, and a second electrode part resiliently connected to said associated lever for engaging an end of the chain link to be welded, said second part having a sliding contact surface interacting with the sliding contact surface of the first part and movable relative thereto in a direction parallel to said vertical chain link plane and median plane.

23. The machine according to claim 22, wherein the sliding contact surface of said first electrode part is enlarged relative to the first electrode part and extends in the direction of motion of the second electrode part.

24. The machine according to claim 22, wherein said second electrode part is connected to said associated lever by at least one flexible member.

25. The machine according to claim 24, including cooling agent channels in each of said first and second electrode parts and a flexible fluid conducting tube interconnecting the cooling agent channels of said first and second electrode parts.

26. The machine according to claim 24, wherein said flexible member is approximately hairpin-shaped and lies in a plane substantially parallel to the median plane.

27. The machine according to claim 26, wherein said flexible member includes two arms, one arm being connected to said first electrode part and the other arm being connected to said second electrode part, and further including a detachable pipe-joint connection connected in said other arm of the flexible member.

* * * * *